United States Patent [19]

Shea

[11] Patent Number: 4,725,245

[45] Date of Patent: Feb. 16, 1988

[54] ELECTRIC OUTLET ASSEMBLY

[76] Inventor: John W. Shea, 2 Medford Ct., Red Bank, N.J. 07701

[21] Appl. No.: 849,560

[22] Filed: Apr. 8, 1986

[51] Int. Cl.[4] ..... H01R 15/26

[52] U.S. Cl. ..... 439/312; 439/332

[58] Field of Search ..... 339/75 M, 75 P, 88 R, 339/94 R, 147 R, 147 C, 166 R; 439/296, 312, 332

[56] References Cited

U.S. PATENT DOCUMENTS

| | | | |
|---|---|---|---|
| 894,703 | 7/1908 | Sanford . | |
| 1,805,572 | 7/1927 | De Mask . | |
| 2,467,981 | 4/1949 | Lavoie | 173/330 |
| 2,871,458 | 1/1959 | Rybold, Jr. | 339/91 |
| 3,638,170 | 1/1972 | Clement | 339/135 |
| 3,798,584 | 3/1974 | Person | 339/14 |
| 3,971,619 | 7/1976 | Rohrssen | 339/189 R |

FOREIGN PATENT DOCUMENTS

| | | | |
|---|---|---|---|
| 961451 | 4/1957 | Fed. Rep. of Germany | 339/94 R |

*Primary Examiner*—Z. R. Bilinsky

*Attorney, Agent, or Firm*—Popper, Bobis & Jackson

[57] ABSTRACT

An electric outlet assembly includes a receptacle plate having an opening and an inner surface when secured to a flat surface; first and second U-shaped blocks positioned adjacent the opening at the inner surface for supplying AC current; a ground post positioned in line with the opening at the inner surface for providing a ground contact; and a plug for removably connecting an electric cord to the first and second U-shaped blocks and the ground post. In a first embodiment, the plug includes a flat oval plate having electrical contacts at opposite ends thereof and a connectorpost positioned centrally therein which, when inserted through the opening of the receptacle plate and rotated by 90°, provides electrical connection between the electrical contacts and the U-shaped blocks and between the connector post and the ground post. In a second embodiment, first and second conductive racks are slidably mounted within a housing at spaced apart locations and a non-conductive gear mounted on a ground shaft engages the racks for moving the racks into electrical contact through openings in the housing with the U-shaped blocks, with the ground shaft electrically connecting with the ground post.

22 Claims, 17 Drawing Figures

FIG. 1
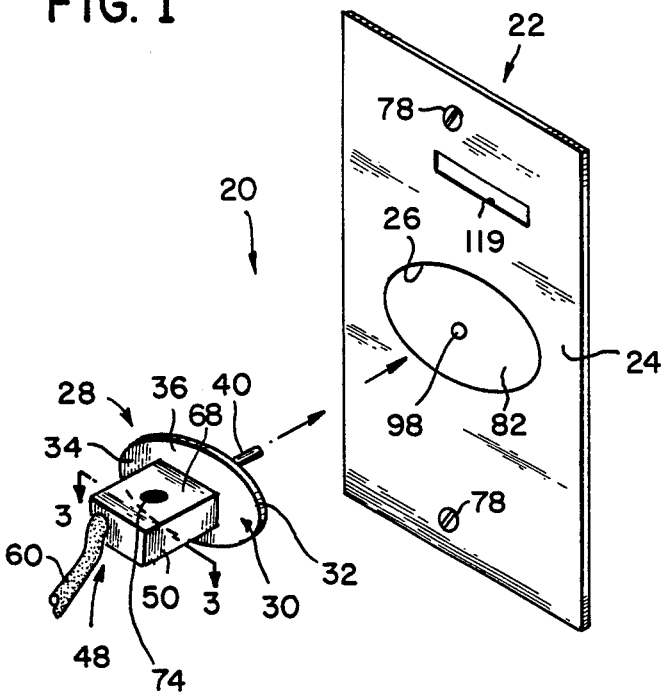
FIG. 2
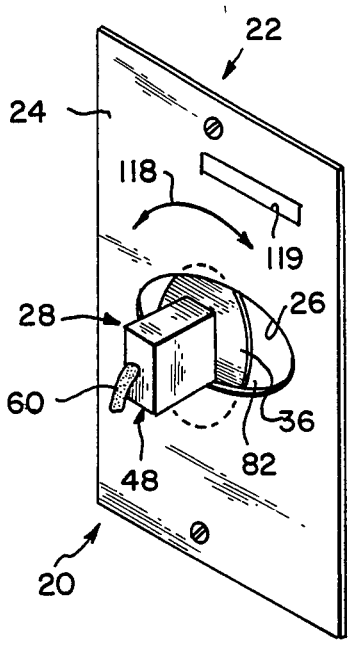
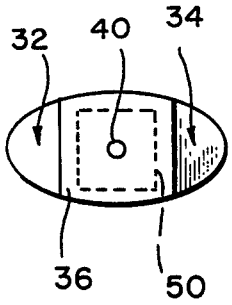
FIG. 4
FIG. 3
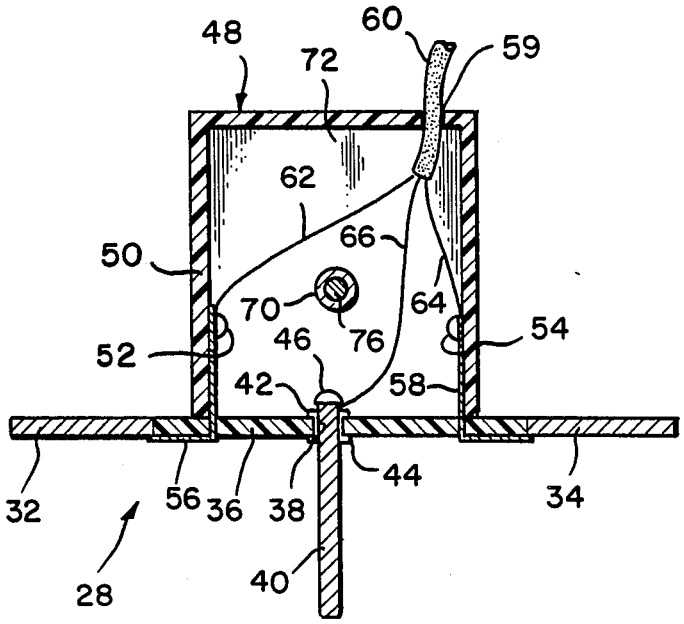

FIG. 5
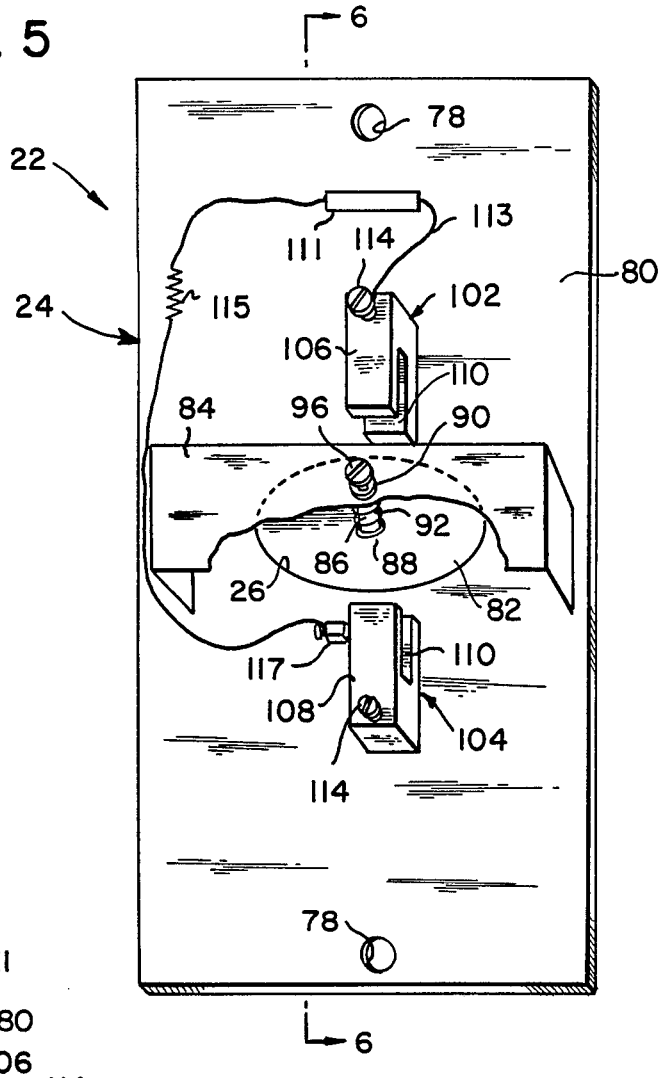
FIG. 5A
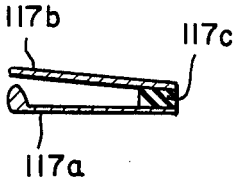
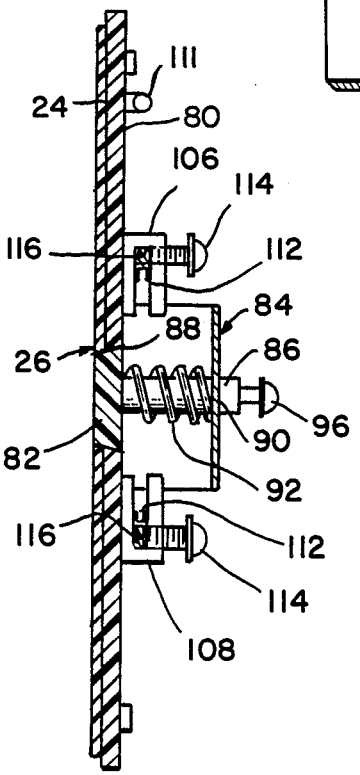
FIG. 6
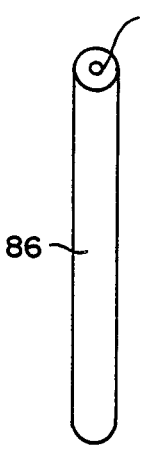
FIG. 7
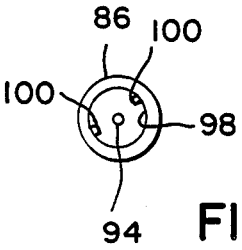
FIG. 8

FIG. 10
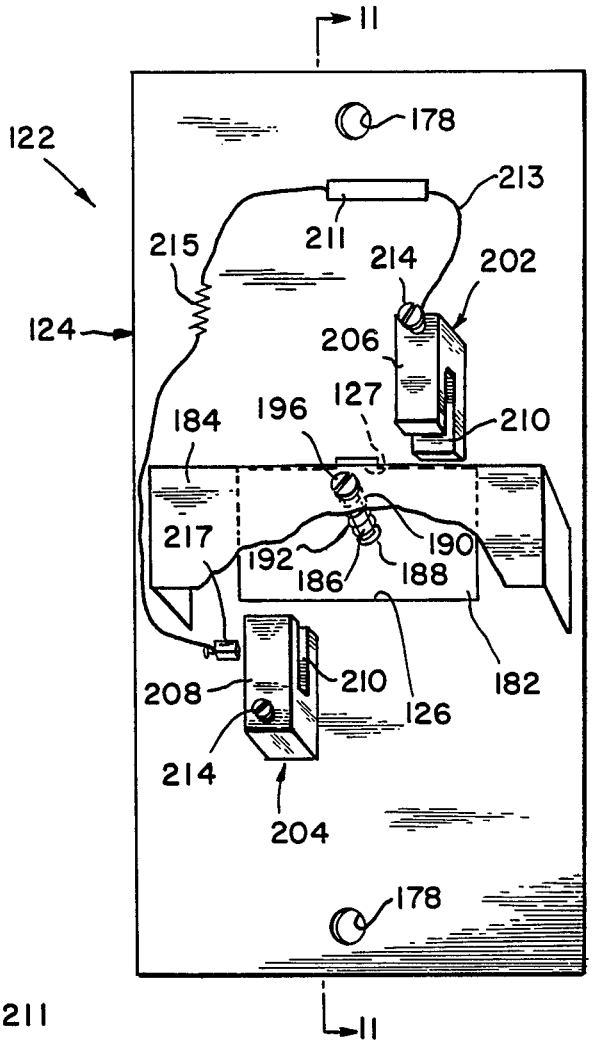
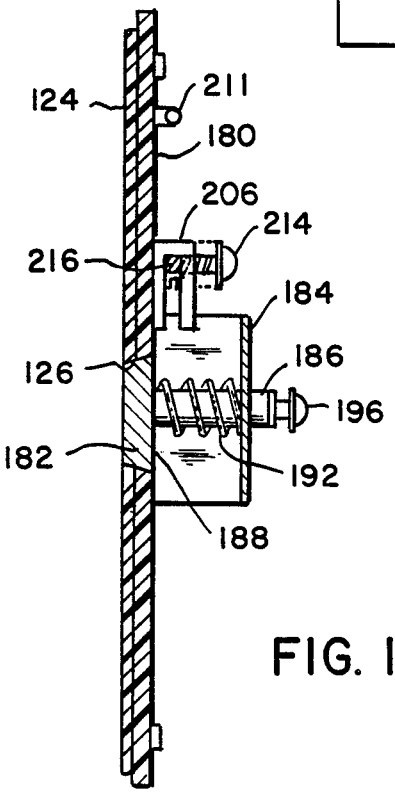
FIG. 11
FIG. 16
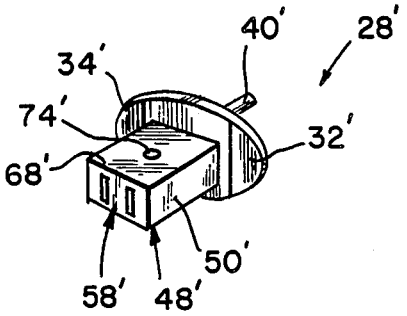

FIG. 12
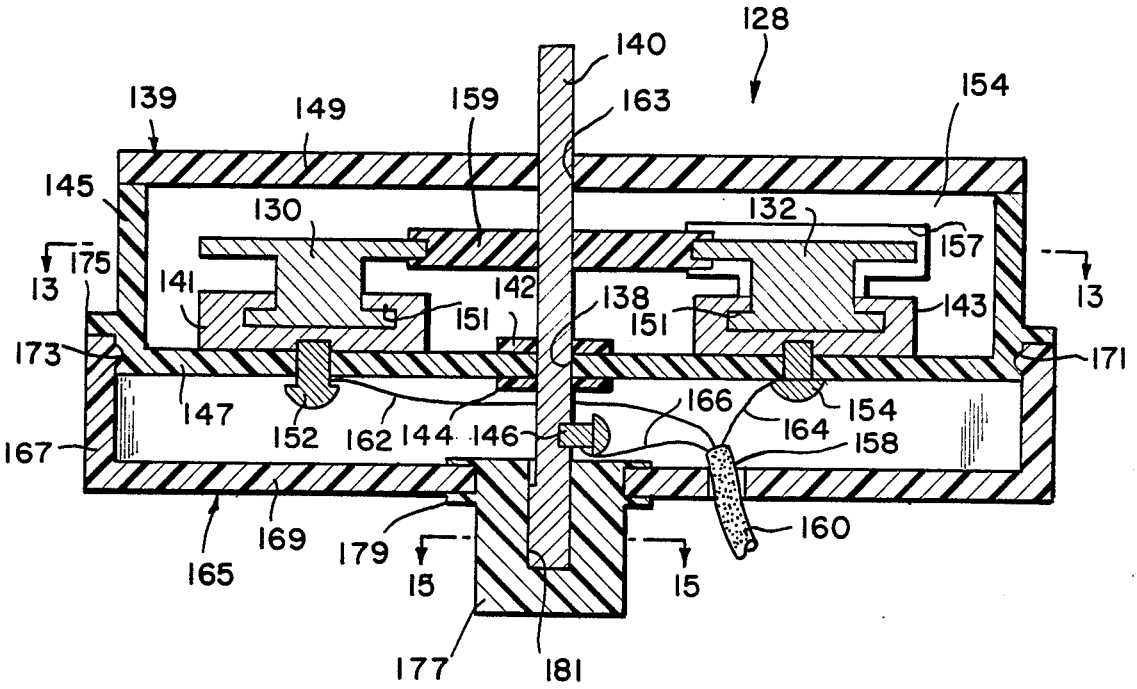
FIG. 15
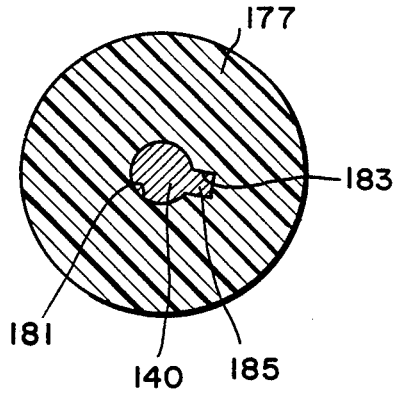
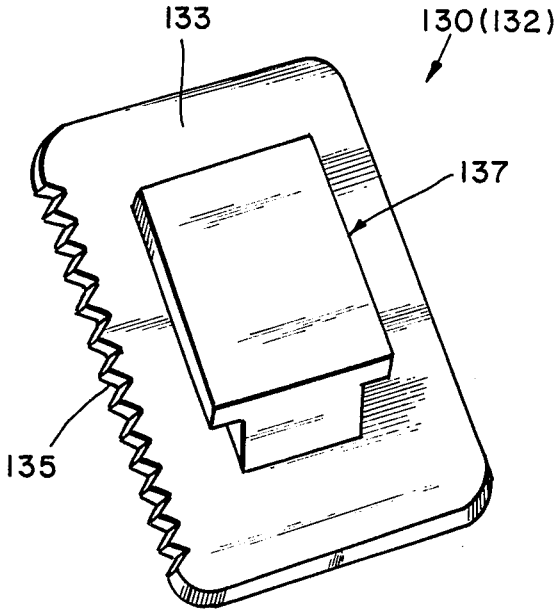
FIG. 14

ELECTRIC OUTLET ASSEMBLY

BACKGROUND OF THE INVENTION

This invention relates generally to electric outlet assemblies and, more particularly, is directed to an electric outlet assembly having a rotatable actuator for electrically connecting a plug with a receptacle.

Conventional electric outlet assemblies generally include a receptacle having three exposed apertures for electrically connecting a three-prong plug of an electrical device. The problem with such assembly is that the apertures of the receptacle remain exposed, thereby presenting a danger of injury to children. For example, a child may be severely injured by inserting a hair pin or other conductive object into a standard electric receptacle.

To overcome this disadvantage, U.S. Pat. Nos. 894,703; 1,805,572; 2,467,981; 2,871,458; 3,638,170; 3,798,584; and 3,971,619, each disclose an electric outlet assembly in which the plug includes at least two prongs, at least two of the prongs being bent at an angle away from each other. The receptacle includes electrical contacts behind the face plate thereof and not accessible accept when the prongs are inserted within suitable apertures and the plug is rotated, for example, by 90°.

With many of the devices, the prongs must fit within specially designed apertures in the receptacle, thereby making it difficult to quickly and easily connect and disconnect the plug.

Further, with the devices of all of the above patents, there is a problem in constructing the plug. This is because the prongs have a peculiar shape. Therefore, if the plug is constructed as an integral unit, the manufacture thereof becomes extremely difficult. If the plug is made from a plurality of pieces, it then increases the manufacturing costs and difficulty since the prongs must be separately secured to a backing plate.

In addition, since the prongs are always exposed when not in use, there is the problem of damaging and/or breaking off of the prongs from the plug.

OBJECTS AND SUMMARY OF THE INVENTION

Accordingly, it is an object of the present invention to provide an electric outlet assembly in which the electrical contacts of the receptacle are not exposed.

It is another object of the present invention to provide an electric outlet assembly in which the electrical contacts of the receptacle are accessible only by a specially constructed plug according to the present invention.

It is still another object of the present invention to provide an electric outlet assembly having a plug with a gre tly simplified construction.

It is yet another object of the present invention to provide an electric outlet assembly in which the electrical contacts of the plug are built into a backing plate thereof.

It is a further object of the present invention to provide and electric outlet assembly in which the electrical contacts of the plug are not exposed during non-use thereof.

In accordance with a first embodiment of the present invention, an electric outlet assembly includes a receptacle plate having an opening and an inner surface when secured to a flat surface; first electrical contact means positioned adjacent the opening at the inner surface for supplying current of a first polarity; second electrical contact means positioned adjacent the opening at the inner surface for supplying current of the second, opposite polarity; ground post means for providing a ground contact, the ground post means positioned in line with the opening at the inner surface and including third electrical contact means for providing the ground contact; and plug means for removably connecting an electric cord to the first, second and third electrical contact means, the plug means including a flat plate having dimensions less than those of the opening to permit insertion of the plate through the opening, fourth and fifth electrical contact means disposed at spaced apart, peripheral portions of the plate, connector post means for electrically contacting the third electrical contact means of the ground post means, and extending substantially from the plate for rotatable and slidable engagement with the ground post means to permit rotation of the flat plate such that the fourth and fifth electrical contact means of the plug means electrically contact the first and second electrical contact means, respectively, means for electrically connecting the fourth and fifth electrical contact means and the connector post means to respective wires of the electric cord, and rotating means for rotating the plate about the ground post means to electrically connect the fourth and fifth electrical contact means with the first and second contact means, respectively.

In accordance with a second embodiment of the present invention, an electric outlet assembly includes a receptacle plate having an opening, and an inner surface when secured to a flat surface; first electrical contact means positioned adjacent the opening at the inner surface for supplying current of a first polarity; second electrical contact means positioned adjacent the opening at the inner surface for supplying current of a second, opposite polarity; ground means for providing a ground contact, the ground means positioned in line with the opening at the inner surface and including third electrical contact means for providing the ground contact; and plug means for removably connecting an electric cord to the first, second and third electrical contact means, the plug means including a housing having dimensions less than those of the opening to permit insertion of the housing through the opening, first and second conductive rack means mounted to the housing at spaced apart locations, non-conductive rotatable gear means engaging the first and second rack means for moving the first and second rack means between a first position into electrical contact with the first and second electrical contact means and a second position out of electrical contact with the first and second electrical contact means, shaft means for rotatably supporting the gear means on the housing in engagement with the first and second rack means and for electrically contacting the third electrical contact means of the ground means, means for electrically connecting the first and second rack means and the shaft means to respective wires of the electric cord, and rotating means for rotating the gear means about the shaft means to electrically connect the first and second rack means with the first and second electrical contact means, respectively.

The above and other objects, features and advantages of the present invention will become readily apparent from the following detailed description thereof which is to be read in connection with the accompanying drawings.

BRIEF DESCRIPTION OF THE DRAWINGS

FIG. 1 is a perspective view of an electric outlet assembly according to a first embodiment of the present invention in a unassembled position;

FIG. 2 is a perspective view of the electric outlet assembly of FIG. 1 in an assembled position;

FIG. 3 is a cross-sectional view of the plug of FIG. 1, taken along line 3—3 thereof;

FIG. 4 is a front plan view of the plug of FIG. 1;

FIG. 5 is a rear perspective view of the receptacle of FIG. 1;

FIG. 5A is a modification of a metal contact that can be used with the receptacle of FIG. 5;

FIG. 6 is a cross-sectional view of the receptacle of FIG. 5, taken along line 6—6 thereof;

FIG. 7 is a perspective view of the ground post of the receptacle of FIG. 5;

FIG. 8 is a bottom plan view of the ground post of FIG. 7;

FIG. 10 is a rear perspective view of the receptacle of FIG. 9;

FIG. 11 is a cross-sectional view of the receptacle of FIG. 10, taken along line 11—11 thereof;

FIG. 12 is a longitudinal cross-sectional view of a plug that ca be used with the receptacle of FIG. 10;

FIG. 14 is a bottom perspective view of an electrical contact of the plug of FIG. 12;

FIG. 15 is a cross-sectional view of the plug of FIG. 12, taken along line 15—15 thereof; and FIG. 16 is a perspective view of a plug of an electric outlet assembly according to another embodiment of the present invention.

DETAILED DESCRIPTION OF THE PREFERRED EMBODIMENTS

Figure 13:
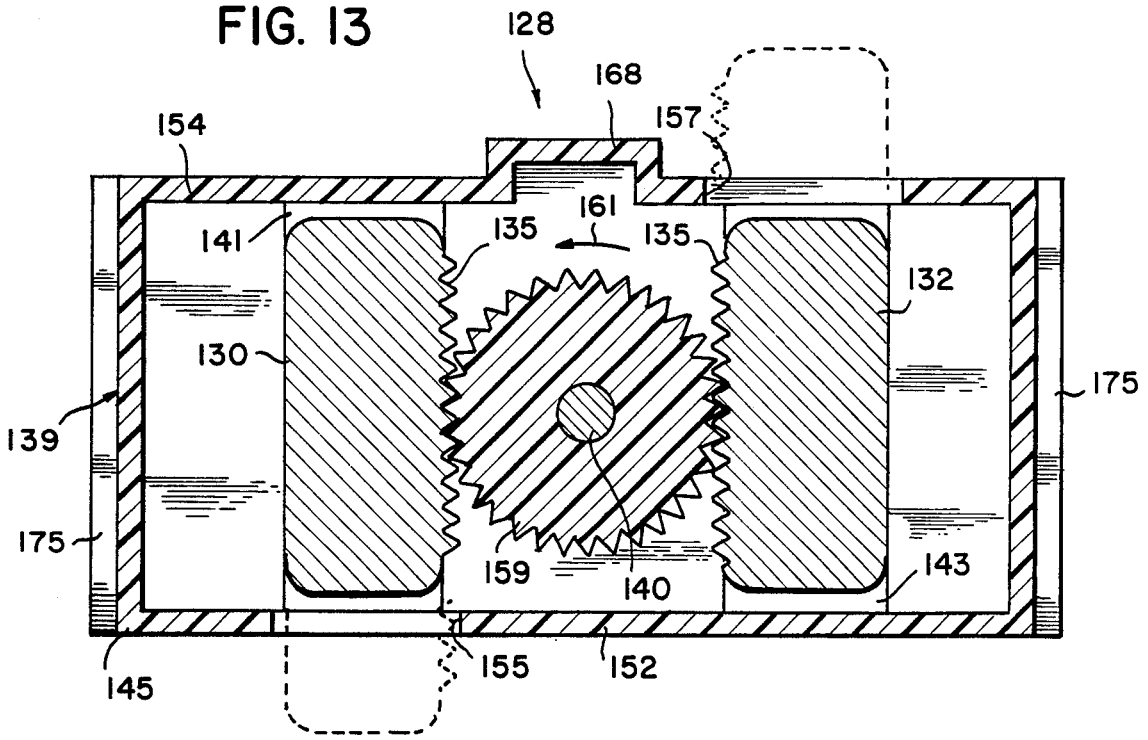
FIG. 13 is a cross-sectional view of the plug of FIG. 12, taken along line 13—13 thereof.

Referring to the drawings in detail, and initially to FIGS. 1 and 2 thereof, an electric outlet assembly 20 according to a first embodiment of the present invention generally includes a receptacle 22 formed of a receptacle plate 24 with a central aperture 26 having an oblong configuration with outwardly tapered or inclined side walls. Electrical contact means are provided on the opposite side of receptacle plate 22, as will be discussed in greater detail hereinafter. Electric outlet assembly 20 further includes a plug 28 formed by an elongated thin plate 30 having a configuration similar to that of oblong aperture 26 but having smaller dimensions to permit insertion of plate 30 therethrough. Plate 30 has opposite electrically conductive ends 32 and 34 which electrically connect plug 28 to electrical contacts of receptacle 22 when plate 30 is inserted through aperture 26 and rotated by approximately 90° therein, as shown in FIG. 2.

Referring more particularly to FIGS. 1, 3 and 4, electrically conductive ends 32 and 34 of thin plate 30 are constructed from a metallic, electrically conductive material and a non-conductive central portion 36 is sandwiched therebetween. Central portion 36 includes a small central aperture 38 which receives a connector post 40 of plug 28. Connector post 40 is made of a conductive material and has one end secured with central aperture 38, with the opposite end thereof extending outwardly therefrom. As one means of securing connector post 40 within central aperture 38, nuts 42 and 44 may be screw-threadedly received on connector post 40 on opposite sides of aperture 38 to secured connector post 40 at the position shown in FIG. 3. Connector post 40 also includes an internal screw-threaded aperture (not shown) at the end secured within aperture 38, which receives a screw 46. As will be explained in greater detail hereinafter, connector post 40 serves to slidably and rotatably position plug 28 within receptacle 22, and also functions as a ground contact for plug 28.

A rotatable actuator 48 of plug 28 is formed by a box 50 of a non-conductive material and which is open at its upper end. Box 50 is secured to the rear surface of central portion 36 or may be formed integrally therewith. Although box 50 is shown as having a rectangular configuration, it is not limited to such configuration. First and second electrically conductive screws 52 and 54 are secured to respective opposite inner walls of box 50 and are electrically connected to conductive ends 32 and 34, respectively, of plate 30 by means of electric strips 56 and 58, respectively. It will be appreciated that electric strips 56 and 58 do not extend on the outer wall of box 50 or on the rear face of plate 30 so that no electrically conductive portion is exposed when plug 28 is electrically connected within receptacle 22.

It will be appreciated that various modifications can be made to the structure so far defined. For example, to absolutely ensure that no electrically conductive portion is exposed when plug 28 is electrically connected within receptacle 22, and for ease of manufacture, plate 30 may be made entirely of a non-conductive material and the front face at opposite ends thereof can be coated with an electrically conductive material.

As shown in FIG. 3, box 50 includes an aperture 59 in an end wall thereof through which an electric cord 60 can be inserted. Electric cord 60 has its opposite end connected to an electrical device, such as a lamp or the like. Generally, electric cord 60 includes three electrically conductive wires 62, 64 and 66, each surrounded by a layer of insulation, with an additional layer of insulation surrounding all of the wires. Wires 62 and 64 function to relay electricity to and from the electrical device and, in this regard, constitute negative and positive polarity wires, respectively, for carrying AC current. Wire 66, on the other hand constitutes a ground wire. Thus, the free end of electric cord 60 is inserted within aperture 59 and wires 62, 64 and 66 are connected therein by means of screws 52, 54 and 46, respectively.

Thereafter, a cover 68 is positioned over the open upper end of box 50 and secured thereat by any suitable means. For example, box 50 may be formed with an upstanding post 70 extending from bottom wall 72 of box 50. Post 70 is hollow and includes internal screw threads. In correspondence thereto, cover 68 includes an aperture 74 aligned with post 70 when positioned on box 50. A screw 76 extends through aperture 74 and is screw-threadedly received within post 70 to secure cover 68 onto box 50.

With the arrangement of plug 28 thus described, two wires 62 and 64 of electric cord 60 are electrically connected to electrically conductive ends 32 and 34 of plate 30, while the remaining wire 66 is electrically connected with connector post 40.

Referring now to FIGS. 5–8, receptacle 22 includes opposite apertures 78 by which it can be secured to a flat surface, such as a wall. When secured to such a flat surface, the rear surface thereof constitutes an inner surface 80.

As shown in FIGS. 5 and 6, a protective plate 82 having tapered walls with similar dimensions to those of oblong opening 26 is normally biased into opening 26 to entirely cover the same so as to prevent access therethrough during non-use. In this regard, an inverted U-shaped support 84 spans the width of and is secured to inner surface 80 in a bridge-like configuration at a position directly over oblong opening 26. A ground post 86 is secured at one end thereof to the rear surface 88 of protective plate 82, the opposite end extending through and slidably received within a central aperture 90 of support 84. A coil spring 92 surrounds ground post 86 and extends between support 84 and protective plate 82. Since support 84 is secured to inner surface 80, spring 92 normally biases protective plate 82 into oblong opening 26, as shown in FIGS. 5 and 6.

As shown in FIGS. 7 and 8, ground post 86 is provided with a screw-threaded aperture 94 at its upper end for receiving a screw 96 therein. Ground post 86 is made of an electrically conductive material. Thus, when installing receptacle 22 to a flat surface, a ground wire within the wall can be electrically connected thereto by means of screw 96. As shown in FIG. 8, the lower end of ground post 86 has an axial aperture 98 for receiving connector post 40 when plug 28 is inserted through oblong opening 26. In order to ensure contact between connector post 40 and ground post 86 when connector post 40 is received within axial aperture 98, flexible metal brushes 100 may be positioned within axial aperture 98 and secured to the inner surface of ground post 86. Thus, when connector post 40 is slidably and rotatably received within aperture 98, it is in electrical contact at all times with ground post 86.

It will be appreciated that various modifications can be made with the arrangement thus far described. For example, instead of constructing ground post 86 from an electrically conductive material, ground post 86 can be constructed from a non-conducting material, and coated along the inner surface within aperture 98 with an electrically conductive material. Thus, electric current would only flow within ground post 86 to screw 96 and the ground wire attached thereto.

As shown in FIGS. 5 and 6, first and second electrical contacts 102 and 104 are secured to inner surface 80 on opposite sides of oblong opening 26 in the longitudinal direction of receptacle plate 24. Generally, electrical contacts 102 and 104 are identically formed and are constructed from U-shaped blocks 106 and 108, respectively, with the legs thereof facing toward oblong opening 26. In other words, the space 110 between the legs of U-shaped blocks 106 and 108 opens toward oblong opening 26. U-shaped blocks 106 and 108 are constructed from an electrically non-conductive material, such as plastic or the like and include a conducting insert 112, made of a metal such as bronze or the like, secured within the respective space 110, as shown in FIG. 6. A conducting screw 114 is received within an end section of each block 106 and 108 and is electrically connected with conducting inserts 112 through any suitable means 116. In this manner, wires within the wall which carry electric current of positive and negative polarity can be secured to U-shaped blocks 106 and 108 by screws 114.

With the arrangement described above, plug 28 and, in particular, thin plate 30, is inserted through oblong opening 26 such that connector post 40 is slidable and rotatably received within aperture 98 of ground post 86. Accordingly, thin plate 30 is moved into contact with the outer facing surface of protective plate 82. Upon the continued application of a force on plug 28, plate 30 biases protective plate 82 against the force of spring 92 so as to move protective plate 82 out of oblong opening 26. Then, with plate 30 positioned through oblong opening 26, plate 30 is rotated in the direction of arrow 118 in FIG. 2 to the position shown therein. In such position, electrically conductive ends 32 and 34 of plate 30 are positioned within spaces 110 of U-shaped blocks 106 and 108, respectively into electrical contact with conducting inserts 112. Therefore, electrically conductive ends 32 and 34 are supplied with an AC current, while connector post 40 is connected to ground through ground post 86. To disconnect plug 28, the reverse procedure is followed.

As shown in FIGS. 1, 2, 5 and 6, in order to inform the user that plug 28 is electrically connected, a neon light 111 or other suitable light source is electrically connected at one end by a wire 113 to screw 114 of U-shaped block 106, and thereby supplied with electric current of a positive polarity. The opposite end of neon light 111 is connected through a resistor 115 to a metal contact 117, the latter being secured to inner surface 80 of receptacle plate 24, adjacent U-shaped block 108. When plug 28 is not inserted within receptacle 22, there is a discontinuous circuit for neon light 111, so that the latter is not supplied with power, and thereby not illuminated. However, when plug 28 is inserted within receptacle 22 and in contact with U-shaped blocks 106 and 108 to supply power to plug 28, electrically conductive end 34 of plate 30, which is positioned within the space 110 of U-shaped 108, also electrically contacts metal contact 117. As a result, the opposite end of neon light 111 is now connected to a source of electric current of negative polarity, thereby completing the circuit, whereby neon light 111 is illuminated. An aperture 119 is provided in receptacle plate 24 in front of neon light 111 which can be viewed by the user and which informs the user that electric current is being supplied to plug 28.

Alternatively, as shown in FIG. 5A, metal contact 117 can be replaced by a pair of spring contacts 117*a* and 117*b* which are secured at opposite ends to an insulating member 117*c*. When electrically conductive end 34 of plate 30 is positioned within the space 110 of U-shaped block 108, it presses down or baises spring contact 117*b* into electrical contact with spring contact 117*a*. In such case, with the opposite end of neon light 111 being connected to spring contact 117*a* through resistor 115, electrical contact is thereby completed between the opposite end of neon light 111 and a source of electric current of negative polarity, thereby illuminating neon light 111.

Electric outlet assembly 20 according to this first embodiment of the present invention provides distinct advantages over the prior art. In the first place, since a thin plate 30 is used, there is no need to provide separate prongs for electrically connecting plug 38. In this manner, a central opening 26 is provided, rather than discrete openings, making it easier to position plug 28 within receptacle 22. Also, since no prongs are used, the problem of bending or breaking of the prongs does not occur with the present invention. Further, since a simple flat plate is used, a greatly simplified structure is provided, thereby rendering the manufacturing and assembly relatively easy in comparison with prior art structures. In addition, a relatively straight forward manner of covering opening 26 is provided.

Referring to FIG. 16, a converter plug 28' is shown, which is a modification of plug 28, and in which elements that are identical to those of plug 28 are represented by the same numerals with a prime (') added, a detailed description of such like elements being omitted herein for the sake of brevity. Specifically, a two-prong converter socket 58' is provided in the end wall of box 50 of actuator 48. Electrical contacts (not shown) within box 50 are contacted by the prongs of a two-prong conventional plug (not shown) when the latter is inserted within converter socket 58', such electrical contacts being electrically connected with strips 56 and 58 (FIG. 3). Thus, when a conventional two-prong plug is inserted with converter socket 58', and when plug 28' is inserted within receptacle 22 and turned, electrical contact is made with the two-prong plug. Of course, a three-prong plug can be used, with plug 28' being modified accordingly.

Referring now to FIGS. 9–15, an electric outlet assembly 120 according to a second embodiment of the present invention will be described in which elements that are identical to those of electric outlet assembly 20 are represented by the same numerals augmented by 100, and a detailed description thereof will be omitted herein for the sake of brevity.

Figure 9:
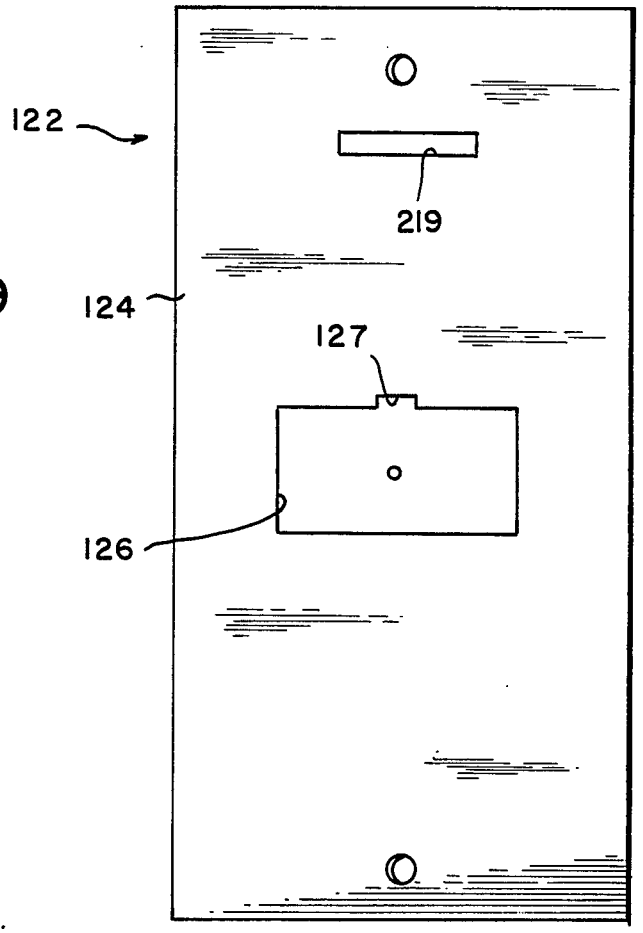
FIG. 9 is a front plan view of the receptacle of an electric outlet assembly according to a second embodiment of the present invention.

Electric outlet assembly 120 includes a receptacle 122 including a thin flat receptacle plate 124 with a central rectangular opening 126 having outwardly tapered or inclined side walls. It will be appreciated that opening 126 may be any suitable configuration, and the present embodiment is not limited to a rectangular shaped opening. As shown in FIG. 9, a notched opening 127 is formed at one side of rectangular opening 126, the reason for which will be apparent from the discussion hereinafter. Electric outlet assembly 120 further includes a plug 128 shown in FIGS. 12 and 13 having outer dimensions which enable it to fit through rectangular opening 126 for electrically connecting an electric device (not shown) to a power source.

Referring first to FIGS. 12–15, plug 128 includes electrically conductive racks 130 and 132. As shown in FIG. 14, each rack 132 and 134 is formed of an elongated rectangular plate 133 having gear teeth 135 extending along one longitudinal edge thereof. Each rack 130 and 132 further includes a support structure 137 of a substantially T-shaped configuration secured to the bottom of plate 133 and having lengthwise dimensions generally less than plate 133, as shown in FIG. 14.

Racks 130 and 132 are supported in a housing 139 by means of electrically conductive rack supports 141 and 143. Specifically, housing 139 is formed of a substantially rectangular electrically non-conducting box 145 having a bottom wall 147, an opposite open end over which a cover 149 is secured by any suitable means, and a tab section 168. Rack supports 141 and 143 are secured to bottom wall 147 in parallel, spaced apart relation. Rack supports 141 and 143 each include a track 151 which slidably receives support structures 137 of racks 130 and 132, respectively, for electrically connecting and slidably supporting racks 130 and 132 within housing 139, such that gear teeth 135 of racks 130 and 132 oppose each other. Opposite end walls 152 and 154 of housing 139 include openings 155 and 157, respectively, having the same general cross-sectional configuration of racks 130 and 132, as shown more particularly in FIGS. 12 and 13, to permit racks 130 and 132 to slide therethrough, as shown by the dashed lines in FIG. 13. In the latter position, racks 130 and 132 are electrically connected with conductive means of receptacle 122, as will be described in greater detail hereinafter.

In order to bias racks 130 and 132 to the dashed line positions shown in FIG. 13, an electrically non-conducting gear 159 is positioned between racks 130 and 132 in meshing engagement with gear teeth 135 thereof. Thus, as gear 159 is rotated in the direction of arrow 161, racks 130 and 132 are moved to the dashed line positions of FIG. 13 through openings 155 and 157, respectively. Rotation of gear 159 in the opposite direction moves racks 130 and 132 back within housing 139. Gear 159 is centrally and fixedly supported on an electrically conductive connector post 140 which extends through a central aperture 138 of bottom wall 147 and which is rotatably secured therein by nuts 142 and 144 secured to connector post 140 on opposite sides of central aperture 138. Connector post 140 also rotatably extends through a central aperture 163 in cover 149, as shown in FIG. 12.

In order to electrically connect plug 128 to an electric cord 160 having wires 162 and 164 to be supplied with an AC current and a wire 166 to be connected to ground, suitable means are provided for electrically connecting these wires to rack supports 141 and 143 and connector post 140, respectively. Specifically, such means includes a first screw 152 screw-threadedly received within bottom wall 147 and in electrical contact with rack support 141 and a second screw 154 screw-threadedly received within bottom wall 147 and in electrical contact with rack support 143. Wires 162 and 164 are connected to screws 152 and 154. A third screw 146 is secured transversely within connector post 140 as it extends out of bottom wall 147 for electrically connecting wire 166 to connector post 140.

A bottom electrically non-conducting cover 165 is provided in covering relation to screws 146, 152, and 154 and connector post 140 to prevent any accidental shock during usage. Specifically, cover 165 includes a rectangular housing 167 open at its upper end and including a bottom wall 169. In order to secure bottom cover 165 onto housing 139, the peripheral edge of bottom wall 147 is provided with two grooves 171 extending along two sides, and the upper, inner end of housing 167 is provided with beads 173 which are received within grooves 171 for removably securing bottom cover 165 onto housing 139. It will be appreciated that such removable feature of bottom cover 165 results from the resiliency of the material from which bottom cover 165 is constructed. Flanges 175 are provided on box 145 adjacent to grooves 171 to accurately align beads 173 and grooves 171 in mating relation.

A knob 177 is rotatably secured within a central opening 179 of bottom wall 169, as shown in FIG. 12, and includes a central aperture 181 provided with a keyway 183, as shown more particularly in FIG. 15. Connector post 140 is provided at its opposite end with a key 185 which fits within keyway 183. In this regard, when knob 177 is rotated by a small angle, connector post 140 and gear 159 thereon are also rotated. As a result, racks 130 and 132, depending upon the direction of rotation, are caused to slide into or out of housing 139. Alternatively, and within the scope of the present invention, a lever, key turned switch or the like can be used to rotate gear 159.

In order to electrically connect electric cord 160 with racks 130 and 132, bottom cover 165 is removed from housing 139 by merely pulling it off therefrom. Then, electric cord 160 is inserted through an aperture 158 in bottom wall 169 and wires 162, 164 and 166 are secured by screws 152, 154 and 146, respectively. Then, bottom cover 165 is assembled with housing 139, as shown in FIG. 12, such that key 185 of connector post 140 slidably fits within keyway 183.

Referring now to FIGS. 9–11, receptacle 122 is constructed in a similar manner to receptacle 22 of FIGS. 5 and 6 and a detailed description thereof will be omitted herein, except for the differences in structure.

Specifically, electrical contacts 202 and 204 are offset from each other in the widthwise direction of receptacle 122, as shown in FIG. 10. This is because of the offset nature of racks 130 and 132. Thus, when racks 130 and 132 are moved to the dashed line positions of FIG. 13, rectangular plates 133 thereof slide within spaces 210 of U-shaped blocks 206 and 208 in the same manner as discussed in the first embodiment of FIGS. 1–8. The other difference between receptacle 122 and receptacle 22 is that protective plate 182 is of a rectangular, rather than oval, configuration in order to cover rectangular opening 126.

In operation, plug 128 is inserted through opening 126 of receptacle plate 124. Tab section 168 of housing 139 fits within notched opening 127 in receptacle plate 124. Thus, plug 128 can only be inserted with one orientation. When inserted through opening 126, connector post 140 fits within ground post 186 and is electrically connected therewith. Thus, ground wire 166 is electrically connected to ground. Cover 149 of housing 139 then biases protective plate 182 against the force of spring 192. Thereafter, knob 177 is rotated in the direction of arrow 161 of FIG. 13 to move racks 130 and 132 to the dashed line positions of FIG. 13. In such positions, plates 133 of racks 130 and 132 are positioned with spaces 210 of U-shaped blocks 208 and 206, respectively and are electrically connected therewith to receive AC current. Further, since plates 133 are positioned with spaces 210, plug 128 is locked in such position and cannot be removed. To remove plug 128, knob 177 is rotated in the opposite direction and plug 128 is removed through opening 126.

It will be appreciated that, with the second embodiment of the present invention, the electrical contacts of the plug for AC connection are normally disposed within housing 139 during non-use so as not to damage the same.

Having described specific preferred embodiments of the invention with reference to the accompanying drawings, it will be appreciated that the present invention is not limited to those precise embodiments, and that various changes and modifications may be effected therein by one of ordinary skill in the art without departing from the spirit or scope of the invention as defined by the appended claims.

What is claimed is:

1. An electric outlet assembly comprising:

a receptacle plate having an opening, and an inner surface when secured to a flat surface;

first electrical contact means positioned adjacent said opening at said inner surface for supplying current of a first polarity;

second electrical contact means positioned adjacent said opening at said inner surface for supplying current of a second, opposite polarity;

ground post means for providing a ground contact, said ground post means positioned in line with said opening at said inner surface and including third electrical contact means for providing said ground contact; and plug means for removably connecting an electric cord to said first, second and third electrical contact means, said plug means including:

a flat plate having dimensions less than those of said opening to permit insertion of said plate through said opening, said plate extending in a plane;

fourth and fifth electrical contact means disposed at spaced apart, peripheral portions of said plate in said plane;

connector post means for electrically contacting said third electrical contact means of said ground post means, and extending substantially centrally from said plate for rotatable and slidable engagement with said ground post means to permit rotation of said flat plate such that said fourth and fifth electrical contact means of said plug means electrically contact said first and second electrical contact means, respectively;

means for electrically connecting said fourth and fifth electrical contact means and third connector post means to respective wires of said electric cord; and rotating means for rotating said plate about said ground post means to electrically connect said fourth and fifth electrical contact means with said first and second electrical contact means, respectively.

2. An electric outlet assembly according to claim 1; wherein said first and second electrical contact means each include a U-shaped block having spaced legs defining a space therebetween for receiving said fourth and fifth electrical contact means therein and in electrical contact therewith.

3. An electric outlet assembly according to claim 2; further comprising screw means for electrically connecting a source of AC power to the U-shaped blocks of said first and second electrical contact means.

4. An electric outlet assembly according to claim 1; further comprising protective plate means for covering the opening of said receptacle plate and biasing means for normally biasing said protective plate means into covering relation with respect to the opening of said receptacle plate.

5. An electric outlet assembly according to claim 4; further including support means fixed with respect to the inner surface of said receptacle plate, said ground means including a ground post connected at one end to said protective plate and slidable through an aperture of said support at an opposite end thereof for slidably moving said protective plate toward and away from the opening of said receptacle plate, and said biasing means includes a spring surrounding said ground post and positioned between said support and said protective plate for normally biasing said protective plate in covering relation with respect to the opening of said receptacle plate.

6. An electric outlet assembly according to claim 5; wherein said protective plate includes a central aperture axially in line with said ground post, and said ground post includes an axially hollowed section for receiving said connector post means through the central aperture of said protective plate.

7. An electric outlet assembly according to claim 1; wherein said rotating means includes a housing secured to a rear surface of said flat plate.

8. An electric outlet assembly according to claim 7; wherein said means for electrically connecting are positioned within said housing and include electrically conductive strip means extending into electrical contact with said fourth and fifth electrical contact means.

9. An electric oulet assembly according to claim 1; further comprising sixth electrical contact means positioned adjacent said second electrical contact means and engaged by said fifth electrical contact means when said rotating means rotates said plate about said ground post means to electrically connect said fifth electrical contact means with said second electrical contact means, and illumination means electrically connected between said first electrical contact means and said sixth electrical contact means.

10. An electric outlet assembly according to claim 1; wherein said plug means further includes at least a two prong socket means for receiving at least a two-prong socket plug, said at least a two-prong socket means being electrically connected with said fourth and fifth electrical contact means.

11. An electric outlet assembly comprising:

a receptacle plate having an opening, and an inner surface when secured to a flat surface;

first electrical contact means positioned adjacent said opening at said inner surface for supplying current of a first polarity;

second electrical contact means positioned adjacent said opening at said inner surface for supplying current of a second, opposite polarity;

ground means for providing a ground contact, said ground means positioned in line with said opening at said inner surface and including third electrical contact means for providing said ground contact; and plug means for removably connecting an electric cord to said first, second and third electrical contact means, said plug means including:

a housing having dimensions less than those of said opening to permit insertion of said housing through said opening;

first and second conductive rack means slidably mounted to said housing at spaced apart locations;

non-conductive rotatable gear means engaging said first and second rack means for moving said first and second rack means between a first position into electrical contact with said first and second electrical contact means and a second position out of electrical contact with said first and second electrical contact means;

shaft means for rotatably supporting said gear means on said housing in engagement with said first and second rack means and for electrically contacting said third electrical contact means of said ground means;

means for electrically connecting the first and second rack means and said shaft means to respective wires of the electric cord; and rotating means for rotating said gear means about said shaft means to electrically connect said first and second rack means with said first and second electrical contact means, respectively.

12. An electric outlet assembly according to claim 11; wherein said first and second electrical contact means each include a U-shaped block having spaced legs defining a space therebetween for receiving said first and second rack means therein and in electrical contact therewith.

13. An electric outlet assembly according to claim 12; further comprising screw means for electrically connecting a source of AC power to the U-shaped blocks of said first and second electrical contact means.

14. An electric outlet assembly according to claim 11; further comprising protective plate means for covering the opening of said receptacle plate and biasing means for normally biasing said protective plate means into covering relation with respect to the opening of said receptacle plate.

15. An electric outlet assembly according to claim 14; further including support means fixed with respect to the inner surface of said receptacle plate, said ground means including a ground post connected at one end to said protective plate and slidable through an aperture of said support at an opposite end thereof for slidably moving said protective plate toward and away from the opening of said receptacle plate, and said biasing means includes a spring surrounding said ground post and positioned between said support and said protective plate for normally biasing said protective plate in covering relation with respect to the openin of said receptacle plate.

16. An electric outlet assembly according to claim 15; wherein said protective plate includes a central aperture axially in line with said ground post, and said ground post includes an axially hollowed section for receiving said shaft means through the central aperture of said protective plate.

17. An electric outlet assembly according to claim 12; wherein said U-shaped blocks are offset with respect to each other.

18. An electric outlet assembly according to claim 11; wherein said means for electrically connecting includes rack support means including first and second tracks for slidably receiving said first and second conductive rack means therein.

19. An electric outlet assembly according to claim 18; wherein said housing includes first and second openings for permitting egress of said first and second conductive rack means therethrough into electrical contact with said first and second electrical contact means, respectively.

20. An electric outlet assembly according to claim 11; further including cover means for covering said means for electrically connecting; and said rotating means includes knob means rotatably received within said cover means and rotatably fixed with said shaft means for rotating said gear means about said shaft means.

21. An electric oulet assembly according to claim 11; further comprising sixth electrical contact means positioned adjacent said second electrical contact means and engaged by said fifth electrical contact means when said rotating means rotates said plate about said ground post means to electrically connect said fifth electrical contact means with said second electrical contact means, and illumination means electrically connected between said first electrical contact means and said sixth electrical contact means.

22. An electric outlet assembly according to claim 11; wherein said plug means further includes at least a two prong socket means for receiving at least a two-prong plug, said at least a two-prong socket means being electrically connected with said fourth and fifth electrical contact means.

* * * * *